US005772417A

United States Patent [19]

Stehr et al.

[11] Patent Number: 5,772,417

[45] Date of Patent: Jun. 30, 1998

[54] GEAR PUMP FOR CONVEYING VISCOUS FLUID MEDIA AND METHOD OF MAKING SAME

[75] Inventors: Roger Stehr, Bülach; Peter Blume, Zürich, both of Switzerland

[73] Assignee: Maag Pump Systems Textron AG, Zurich, Switzerland

[21] Appl. No.: 707,253

[22] Filed: Sep. 3, 1996

[30] Foreign Application Priority Data

Sep. 18, 1995 [EP] European Pat. Off. ..... 95114623

[51] Int. Cl.[6] ..... F04C 2/18; F04C 15/00

[52] U.S. Cl. ..... 418/83; 418/206.3; 418/206.4; 29/888.023

[58] Field of Search ..... 418/83, 206.1, 418/206.3, 206.4; 29/888.02, 888.021, 888.023, DIG. 48

[56] References Cited

U.S. PATENT DOCUMENTS

| | | | |
|---|---|---|---|
| 1,309,237 | 7/1919 | Bausman | 418/206.3 |
| 1,590,964 | 6/1926 | Street | 418/83 |
| 4,725,211 | 2/1988 | Gray | 418/206.4 |

FOREIGN PATENT DOCUMENTS

| | | | |
|---|---|---|---|
| 896297 | 4/1944 | France | 418/206 |
| 1194511 | 5/1959 | France | 418/206 |
| 753585 | 5/1953 | Germany . | |
| 1 941 673 | 2/1971 | Germany . | |
| 24 36 222 | 2/1975 | Germany . | |

*Primary Examiner*—John J. Vrablik

*Attorney, Agent, or Firm*—Evenson McKeown Edwards & Lenahan, PLLC

[57] ABSTRACT

A gear pump for conveying fluid media, particularly viscous media, has tube or collar-type sections on the suction side and/or delivery side for connecting the pump in a weldable manner with additional system components.

9 Claims, 2 Drawing Sheets

GEAR PUMP FOR CONVEYING VISCOUS FLUID MEDIA AND METHOD OF MAKING SAME

BACKGROUND AND SUMMARY OF THE INVENTION

The present invention relates to a gear pump for conveying fluid media, particularly viscous media, as well as to a conveying tube line having a gear pump.

Gear pumps for conveying fluid media, particularly viscous media, are well known and described repeatedly, for example, in German Patent Documents DE-19 41 673 and DE-24 36 222.

In both cases, a gear pump is described which is particularly suitable for the discharge from reactors and has a large-volume pump inlet. In this case, the pump housings are constructed as double-walled so-called "fully jacketed" constructions. In this case, the circulating closed chamber volume permits an excellent guiding of the temperature of the gear pump, which is particularly important in the case of discharge assemblies of polymers during the polymer synthesis. As tempering media, steam or heat carrier oils are used as a rule.

As illustrated, for example, in German Patent Document DE-24 36 222, the feeding of these heating media takes place by way of two or several tempering connection flanges of the pump housing.

In addition, both above-described pump types have a mounting or connection flange on the suction side as well as on the delivery side. It must be possible to connect the pumps in a vacuum-tight manner by means of these flanges with components which are connected in front of or behind them, such as the synthesis reactor, connected conveying tubes, granulating systems, etc.

Particularly on the suction side, there is the danger of an entering of atmospheric pressure by way of the pump flange, which may result in considerable problems in the synthesis reactor arranged above the gear pump.

It is therefore an object of the present invention to provide a mounting possibility on the suction side as well as on the delivery side with respect to the gear pump which permits an absolutely gastight transition to components connected in front and behind.

It is another object of the present invention to provide a simple connection possibility for the feeding and discharging of tempering media into the double-wall housing of the gear pump.

According to preferred embodiments of the invention, these objects are achieved by means of a gear pump of the above-noted type which includes at least one collar welded to the respective pump housing end flange.

A gear pump for conveying fluid media, particularly viscous media, is suggested which, on the suction side and/or delivery side has axial extensions in the form of tube-type or collar-type sections in order to connect the pump in a weldable manner with additional system components connected in front or behind.

In especially preferred embodiments, a gear pump of the initially described type is suggested which has a doubled-walled pump housing with an arrangement for being able to heat and cool the pump. The arrangement is suitable for the flowing-through or penetrating of fluid heating and tempering media, particularly steam or heat carrier oils.

Preferably, the gear pump suggested according to the invention has, in the area of the weldable section or sections, one or several connection opening(s) with the space formed by the double-wall characteristic of the housing, for the feeding and discharging of the heating and tempering medium.

On the suction and/or delivery side of the gear pump, the section or sections are constructed in the form of a tube-shaped collar in order to connect on it a correspondingly dimensioned, tube-shaped opening of a connecting component, such as a tube line, preferably in a butt-welded manner, fixedly with the pump.

Another tube-type collar is arranged coaxially above this one tube-shaped collar on the suction and/or delivery side of the gear pump in order to connect a tube line, which coaxially surrounds the one tube line, preferably in a butt-welded manner, fixedly with the pump, in which case the space formed between the two tube lines may optionally be used for conveying the heating or tempering medium.

Because of the significantly higher pressure conditions on the delivery side of the gear pump, the one tube-type collar is provided on the delivery side preferably with a larger wall thickness than the one tube-type collar on the suction side.

An important advantage of the gear pump suggested according to the invention is the fact that, during the operation, the gear pump is connected in an absolutely gastight manner with a system component connected in front or behind or is installed into a corresponding tube line. This also eliminates the necessity, which is known from conventional pumps from the state of the art, of from time to time replacing ring seals arranged in the connection flanges because they may become brittle, for example, because of high temperatures in the case of connections to synthesis reactors.

Another advantage of the gear pump suggested according to the invention is the fact that no lateral connections for the feeding and leading-away of heating and tempering media must be provided on the gear pump. Finally, the pumps do not have to be removed for their servicing or inspection. By removing the housing cover, the interior parts (shafts, bearings) can be removed and may be installed again later after their inspection.

Other objects, advantages and novel features of the present invention will become apparent from the following detailed description of the invention when considered in conjunction with the accompanying drawings.

DETAILED DESCRIPTION OF THE DRAWINGS

Figure 1:
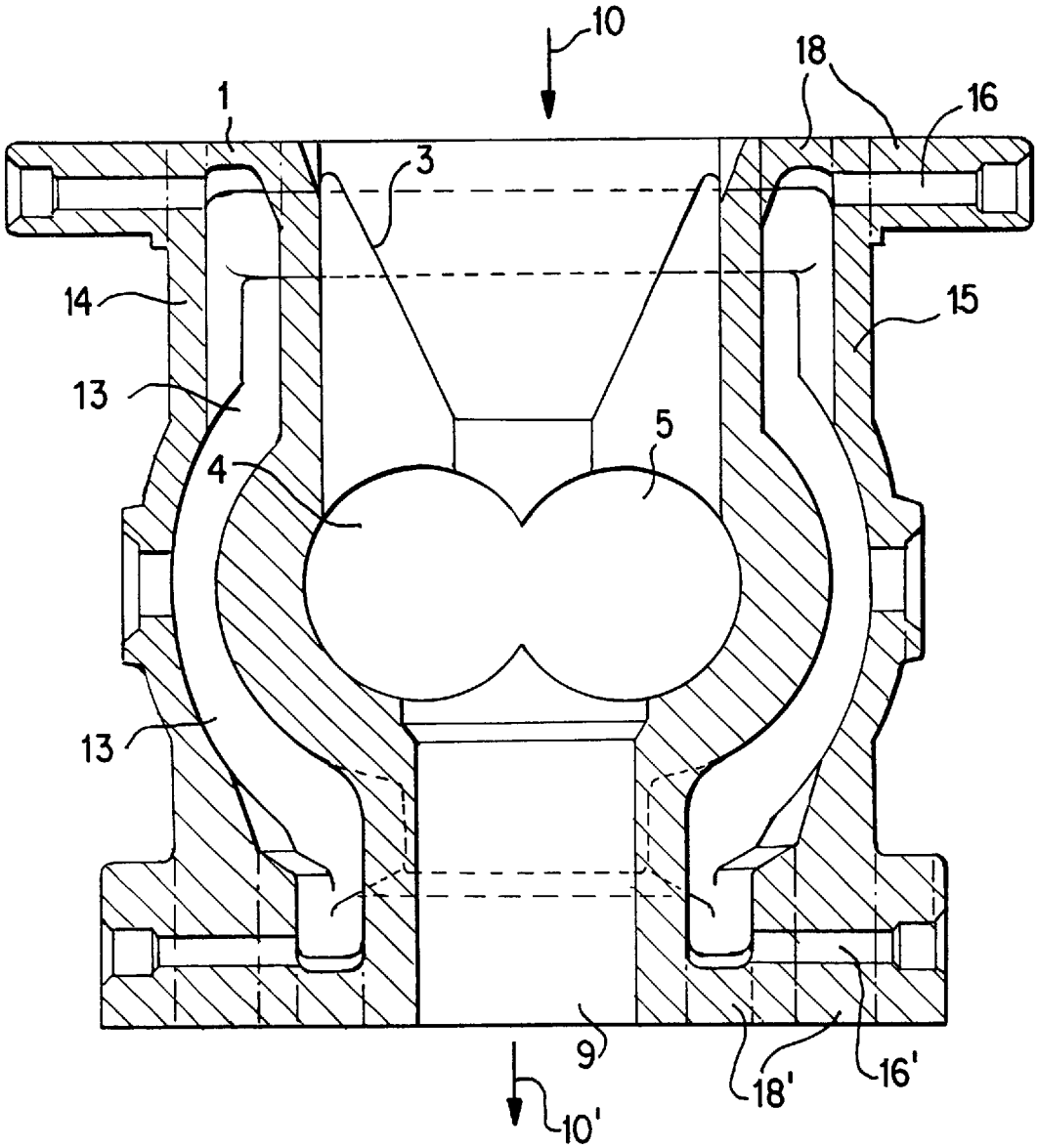
FIG. 1 PRIOR ART
FIG. 1 is a sectional view of a double-walled gear pump known from the prior art.

FIG. 1 is a sectional illustration of a gear pump according to the prior art which has a double-walled housing. The housing 1 of the gear pump contains a vertical inlet opening 3 which is formed by a hollow cone. The medium to be conveyed is introduced into the gear pump in the direction of the arrow 10 and is conveyed through the two serrated shafts 4 and 5 and is pressed against the outlet opening 9. Through the outlet opening 9, the medium to be conveyed is supplied in the direction of the arrow 10' to a component connected behind. As illustrated clearly in FIG. 1, the gear pump has a larger opening on the suction side than on the delivery side at the outlet opening.

As clearly illustrated in FIG. 1, the housing 1 has a double-walled construction, having the exterior wall halves 14 and 15 as well as a space 13 which is the result of the double-walled construction. In the two housing halves 14 and 15, pipes 16 and 16' are arranged for the feeding and discharging of the tempering medium. The space or the ducts 13 form the heating jacket of the pump in order to prevent, for example, in the case of a gear pump connected behind a polymer synthesis, that, because of the rapid cooling of the very viscous polymer, a conveying is made more difficult or virtually impossible. Finally, the gear pump from the prior art illustrated in FIG. 1 has a connection flange 18 or 18' on the suction side as well as on the delivery side in order to connect the pump with components connected in front of and behind it.

Figure 2:
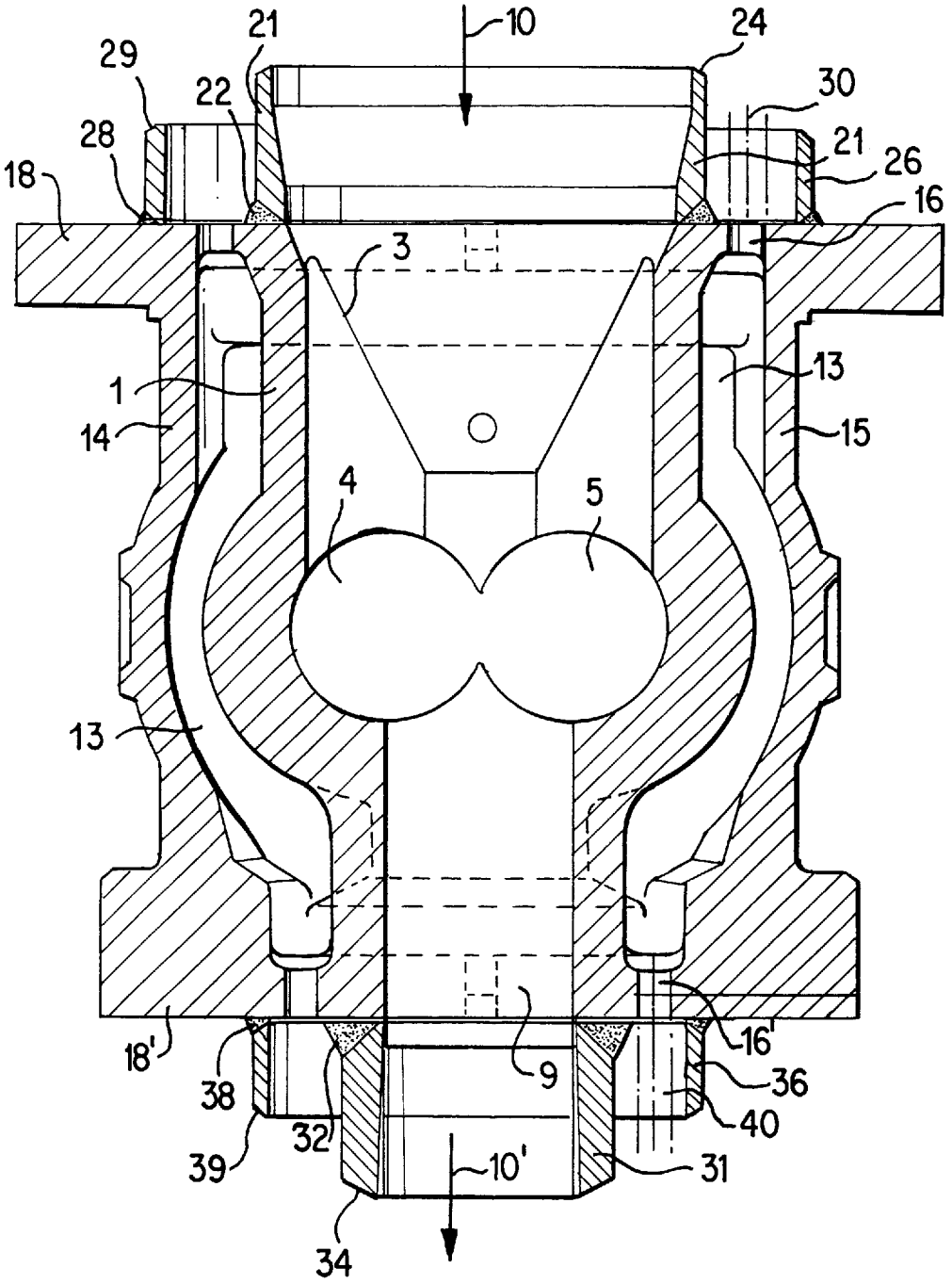
FIG. 2 is a sectional view of a double-walled gear pump constructed according to a preferred embodiment of the present invention.

In contrast, FIG. 2 is a sectional view of a gear pump according to the invention, in which case parts which are analogous with respect to the gear pump of FIG. 1 have the same reference numbers. The pump again has a housing 1 as well as a vertical inlet opening 3 through which the medium to be conveyed is introduced in the direction of the arrow 10. Serrated shafts 4 and 5 drive the medium against the outlet opening 9 where the medium leaves the pump in the direction of the arrow 10' into a component connected behind it. The exterior housing has the two halves 14 and 15 as well as, as a result of the double-walled construction, the spaces or ducts 13 which are provided for the tempering of the gear pump.

According to the invention, the gear pump illustrated in FIG. 2 has two tube-type collar connections 21, 26, 31 and 36 respectively on the suction side as well as on the pressure side, which collar connections are connected, for example, in a butt-welded manner, by way of weldings 22, 28, 32 and 38 with the connection flanges 18 and 18' of the pump. In this case, the two tube-shaped collars 21 and 31 form the interior connections which are provided for being connected with corresponding connections of components connected in front and behind, for guiding the medium to be conveyed. The connection, for example, of tubes which are connected in front of and behind the pump can also be connected with the two tube sections 21 and 31 in a butt-welded manner since these each preferably have connecting parts 24 and 34 which are preferably conically bevelled.

The two additional tube sections 26 and 36 arranged coaxially and outside with respect to the tube sections 21 and 31 are provided for being connected again in a preferably butt-welded manner with exterior jacket tubes which may optionally be arranged coaxially to the connection tubes, in which case, in the jacket space formed by the two coaxial connection tube lines respectively, a tempering medium can be fed to or removed from the gear pump. This again takes place by way of connections 16 and 16', which connect the spaces or ducts 13 with the jacket-type spaces 30 and 40 which are formed in the collar-type connections and the connection tube lines connected therewith in a welded manner.

Thus FIG. 2 clearly illustrates that, during the operation of the gear pump, the initial object is achieved in a reliable manner in that the danger of an entering of atmospheric pressure, for example, on the suction side, is completely avoided. An escaping of the conveyed medium at the connection point is also impossible on the delivery side. The other advantage of the gear pump illustrated according to the invention is the simplicity of the feeding and removal tube for the feeding and removal of the heating and tempering medium.

It is also clearly illustrated in FIG. 2 that the collar-type tube section 31 has a much stronger construction than the corresponding tube section 21 on the suction side. The reason is that much higher pressure conditions exist on the delivery side, for example, of 250 bar or more, while there is atmospheric pressure or a vacuum on the suction side which permits less strong tube lines.

The gear pump illustrated according to the invention is particularly suitable for use as a discharge assembly in the synthesis of polyester, where a very viscous polyester melting must be discharged from synthesis reactors and where, as a rule, large volumes are to be conveyed. Particularly in the case of discharge assemblies of this type, it is important that no atmospheric pressure enters on the suction side. In addition, these discharge assemblies can preferably be heated so that very viscous materials will not become more viscous because of the cooling.

The gear pump according to the invention illustrated in FIG. 2 is only an example which can be changed, supplemented and modified arbitrarily. Thus, different arrangements of the welding sections arranged on the suction side and the delivery side than those shown are also contemplated by the invention. It is also not absolutely necessary according to other contemplated embodiments that the connections of the components connected in front and behind take place by means of butt-welding. The basic idea of the present invention also includes other welding techniques.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Gear pump for conveying viscous fluid media, comprising a pump housing having a pump suction side and a pump discharge side, and at least one collar operatively joined at at least one of the pump suction side and the pump discharge side, said at least one collar being configured and arranged to connect said pump in a gastight manner to at least one associated system component supplying fluid medium for heating and tempering the pump housing between the pump suction side and the pump discharge side;

wherein the pump housing has an at least partially double-walled portion for receiving and the flowing of the heating and tempering fluid medium through a tempering space formed between the double-walled portion for feeding and removing of the heating and tempering fluid medium; and wherein the at least one collar is tube-shaped and is butt welded to the pump housing such that a correspondingly dimensioned tube shaped opening of the at least one adjoining system component is connectable therewith.

2. Gear pump according to claim 1, wherein the at least one collar includes a first tube-shaped collar and a second tube-shaped collar arranged to coaxially surround the first tube-shaped collar to butt-weld together the at least one adjoining component comprising coaxial tube lines with the pump housing, with a space formed between the coaxial tube lines being selectively usable for conveying the heating and tempering fluid medium.

3. Gear pump according to claim 2, wherein the first tube-shaped collar has a larger wall thickness on the pump discharge side than the first tube-shaped collar on the pump suction side.

4. Gear pump assembly comprising:

a first pump housing wall defining a pumping chamber extending in a viscous media pumping direction between a viscous media inlet opening and a viscous media outlet opening, a second pump housing wall surrounding said first housing wall and defining a tempering medium chamber between said first and second housing walls, said first and second housing walls terminating at respective flat inlet and outlet end flanges extending transversely to the pumping direction, and at least one tubular collar welded to one of the end flanges;

wherein said at least one tubular collar includes:

a first viscous medium collar welded to said inlet end flange and surrounding the viscous medium inlet opening, and a first tempering medium collar welded to said inlet end flange and surrounding said first viscous medium collar to form a passage for tempering medium therebetween.

5. Gear pump assembly according to claim 4, wherein said at least one tubular collar includes:

a second viscous medium collar welded to said outlet end flange and surrounding the viscous medium outlet opening, and a second tempering medium collar welded to said outlet end flange and surrounding said second viscous medium collar to form a passage for tempering medium therebetween.

6. Gear pump assembly according to claim 5, wherein said second viscous medium collar has a wall thickness substantially greater than the wall thickness of the first viscous medium collar.

7. A method of manufacturing a gear pump assembly comprising:

providing a first pump housing wall defining a pumping chamber extending in a viscous media pumping direction between a viscous media inlet opening and a viscous media outlet opening, providing a second pump housing wall surrounding said first housing wall and defining a tempering medium chamber between said first and second housing walls, said first and second housing walls terminating at respective flat inlet and outlet end flanges extending transversely to the pumping direction, and welding at least one tubular collar to one of the end flanges;

wherein said at least one tubular collar includes:

a first viscous medium collar welded to said inlet end flange and surrounding the viscous medium inlet opening, and a first tempering medium collar welded to said inlet end flange and surrounding said first viscous medium collar to form a passage for tempering medium therebetween.

8. A method according to claim 7, wherein said at least one tubular collar includes:

a second viscous medium collar welded to said outlet end flange and surrounding the viscous medium outlet opening, and a second tempering medium collar welded to said outlet end flange and surrounding said second viscous medium collar to form a passage for tempering medium therebetween.

9. A method according to claim 8, wherein said second viscous medium collar has a wall thickness substantially greater than the wall thickness of the first viscous medium collar.

* * * * *

UNITED STATES PATENT AND TRADEMARK OFFICE

CERTIFICATE OF CORRECTION

PATENT NO. : 5,772,417

DATED : June 30, 1998

INVENTOR(S) : Roger Stehr and Peter Blume

It is certified that error appears in the above-indentified patent and that said Letters Patent is hereby corrected as shown below:

TITLE PAGE, ITEM [75]:

Please designate the inventors as:

Roger Stehr, Bülach, Switzerland
Peter Blume, Zürich, Switzerland
Walter Schnaus, Rodenbach bei Hanau, Germany
Wolfgang Meier, Ronneburg/Altwiedermus, Germany Signed and Sealed this Twenty-seventh Day of October, 1998

*Attest:*

Bruce Lehman

BRUCE LEHMAN

*Attesting Officer*

*Commissioner of Patents and Trademarks*